US007210575B2

(12) United States Patent
Oswald

(10) Patent No.: US 7,210,575 B2
(45) Date of Patent: May 1, 2007

(54) TWO-COMPONENT PACKAGING UNIT

(75) Inventor: Klaus Oswald, Riedstadt (DE)

(73) Assignee: Boehringer Ingelheim International GmbH, Ingelheim (DE)

( * ) Notice: Subject to any disclaimer, the term of this patent is extended or adjusted under 35 U.S.C. 154(b) by 212 days.

(21) Appl. No.: 10/670,616

(22) Filed: Sep. 25, 2003

(65) Prior Publication Data

US 2004/0112770 A1 Jun. 17, 2004

(30) Foreign Application Priority Data

Sep. 26, 2002 (DE) ..... 102 45 172

(51) Int. Cl.
*B65D 25/08* (2006.01)

(52) U.S. Cl. ..... 206/219; 206/222; 215/DIG. 8

(58) Field of Classification Search ..... 206/219, 206/222; 215/DIG. 8; 422/99, 102; 220/522
See application file for complete search history.

(56) References Cited

U.S. PATENT DOCUMENTS 3,802,604 A 4/1974 Goyet et al.
3,840,136 A 10/1974 Lanfranconi et al.
3,968,872 A 7/1976 Cavazza
4,024,952 A 5/1977 Leitz
4,067,440 A 1/1978 Lataix
4,103,772 A 8/1978 Wiegner
4,195,731 A 4/1980 Cavazza
4,203,517 A 5/1980 Steigerwald et al.
4,465,183 A 8/1984 Iizuka et al.
4,610,374 A 9/1986 Buehler
4,693,366 A 9/1987 Goncalves
4,750,615 A 6/1988 Kaufeler
4,757,916 A 7/1988 Goncalves
4,773,529 A * 9/1988 Finke et al. ..... 206/222
4,793,475 A 12/1988 Itzel
4,796,647 A 1/1989 Gueret
4,962,853 A 10/1990 Hildebrandt
4,982,875 A 1/1991 Pozzi et al.
5,158,546 A 10/1992 Haber et al.
5,170,888 A * 12/1992 Goncalves ..... 206/222
5,284,277 A 2/1994 Leuenberger
5,584,420 A 12/1996 Awada et al.
5,811,060 A * 9/1998 Laguna Valderrama ..... 422/102
5,833,121 A 11/1998 Gueret
5,839,573 A 11/1998 Morini
5,950,819 A * 9/1999 Sellars ..... 206/221
6,068,396 A 5/2000 Baudin
6,113,257 A 9/2000 Inbar et al.
6,148,996 A 11/2000 Morini
6,149,866 A 11/2000 Backman et al.

(Continued)

FOREIGN PATENT DOCUMENTS

DE 24 51 167 5/1976

(Continued)

*Primary Examiner*—David T. Fidei
(74) *Attorney, Agent, or Firm*—Kaplan Gilman Gibson Dernier LLP

(57) ABSTRACT

The invention relates to a packaging unit for two substances to be stored separately from each other and mixed together before use, particularly a liquid and a powdered substance. The invention comprises a first container and a second container which is moveably suspended in the neck of the first container. The second container is moved by screwing tight the closure cap of the first container and thereby opened.

14 Claims, 5 Drawing Sheets

U.S. PATENT DOCUMENTS 6,561,232 B1 5/2003 Frutin

FOREIGN PATENT DOCUMENTS

| | | |
|---|---|---|
| DE | 26 25 175 A1 | 12/1977 |
| DE | 34 37 574 A1 | 4/1986 |
| DE | 36 31 134 | 3/1988 |
| DE | 36 34 080 A1 | 4/1988 |
| DE | 40 08 615 A1 | 9/1991 |
| DE | 86 24 484 | 1/1998 |
| EP | 0 090 361 A2 | 10/1983 |
| EP | 0 251 193 A1 | 1/1988 |
| EP | 0 561 322 A1 | 9/1993 |
| EP | 0 577 200 A1 | 1/1994 |
| EP | 0 599 189 A2 | 6/1994 |
| EP | 0 778 221 A1 | 6/1997 |
| EP | 0 806 371 A1 | 11/1997 |
| EP | 1 122 186 A1 | 8/2001 |
| EP | 1 186 548 | 3/2002 |
| FR | 2 153 767 | 5/1973 |
| FR | 2 279 378 | 2/1976 |
| FR | 2 569 666 | 7/1986 |
| FR | 2 729 372 | 7/1996 |
| GB | 1 403 274 | 8/1975 |
| GB | 2 327 408 A | 1/1999 |
| JP | 8072921 | 3/1996 |
| JP | 9202331 | 8/1997 |
| NL | 7113625 | 12/1975 |
| WO | WO 89/07434 | 8/1989 |
| WO | WO 99/08943 | 2/1999 |
| WO | WO 00/78632 | 12/2000 |
| WO | WO 02/076373 | 10/2002 |

* cited by examiner a.
b.
1
2
3
4
5
6
7
8
9
10
11
12
14
15
16
17
18
19
20
21

TWO-COMPONENT PACKAGING UNIT

DESCRIPTION

The invention relates to a packaging unit for two substances to be stored separately from each other and mixed together before use, particularly a liquid and a powdered substance. The invention comprises a first container and a second container which is moveably suspended in the neck of the first container. The second container is moved by screwing tight the closure cap of the first container and is thereby opened.

In particular the present invention comprises

- a first bottle-like container with a shoulder region and an opening region constricted in the form of a neck for the liquid substance,
- a second container for the powdered substance arranged in the neck-like constricted opening region of the first container and
- a closure cap which covers the opening region.

Packaging units of this kind are required for the separate storage, over a lengthy period of time, of substances which have only a short shelf life once mixed together, between the time of manufacture and use by the end user, in portions corresponding to the prescribed mixing ratio. In this form the individual substances can be stored long enough so that conventional transporting and storage times do not present a problem. As with many other products, expiry dates may have to be adhered to.

In the case of pharmaceutical products the end user on using such packaging units is required to prepare the mixtures himself immediately before use, with the result that he is not dependent on the pharmacist who would otherwise have to mix the preparations for a single use or for a small number of uses. Packaging units of this kind are known for example from European Patent Applications 0093090, 0344849, 0577200 and 0599189. In every case the base of the second container inserted in the opening region of the first container is at least partially severed by means of a sharp object when the closure cap is actuated, so that the powder from the second container is added to the liquid in the first container and the substances can be mixed together. The translatory movement of the sharp object towards the base of the second container and through it is brought about by a translatory or rotary movement of the closure cap once a safety ring has been removed which prevents accidental movement of the closure cap and hence accidental opening of the second container.

The known packaging units have the drawback that the second container can only be opened by destructive actuation of the closure cap, and there is always a danger that small fragments will be produced which will be detached from the second container and/or lid and fall into the mixture. Even if it is not a health risk for the end user to swallow such fragments the experience will unpleasant and disturbing.

A further disadvantage is that in some embodiments the severed base remains attached to the second container via a bridge. In these cases, as the liquid is poured out, it may happen that the base is moved back into the neck of the bottle, thereby blocking it.

A further disadvantage of the known packaging unit is that the closure cap simultaneously acts as a closure for the second container and the first container. Therefore the filling of the packaging units with liquid and powder has to be carried out immediately after one another. The second containers cannot be filled at a different time and location from the first container as they cannot be independently sealed and transported and stored as a separate product.

Finally, some of the known packaging units are suitable only for producing a single portion of mixture as the closure cap is not designed for reliable resealing of the first container once the safety ring has been removed. Packaging units of this kind are substantially less economical than those which can be used to produce quantities of mixture comprising a number of individual portions corresponding to the shelf life of the mixture.

The aim of the invention is to avoid the above-mentioned disadvantages of the known packaging units and provide an alternative which is cheap to produce and can be handled by the end user without any problem.

To achieve this objective a packaging unit of the kind mentioned above is provided which has the following component parts:

- a first bottle-like container (1)—preferably for a liquid component—with a belly region, a shoulder region (2) and a neck with opening region (3), while optionally between the opening region (3) and the side facing the shoulder region there is a preferably annular and/or cylindrical constriction (7) and
- a second container (4) for the powdered substance, arranged in the bottle neck (7) of the container and
- a closure cap (5) covering the opening region, while
- the opening region (3) has a screw thread 6 on its end, on the outside,
- the second container (4) comprises a pot-shaped lower part (8) sealed at the bottom, the maximum external diameter of which is less than the internal diameter of the constriction, and an adjacent upper region open at the top which optionally has a central and an upper part,
- the external diameter of the second container (4) in its upper region has at least one region which is approximately the same size or bigger than the internal diameter of the constriction (7) and which is located below or preferably inside the constriction when the packaging unit is in its initially closed state, and
- the upper part of the second container is closed off by a cup-like lid which can be inserted in the opening in the upper part and totally removed therefrom, and which can be frictionally connected to the interior of the closure cap or is an integral part thereof.

These embodiments enable the second container to be frictionally held in the cylindrical constriction in the first container by means of its bead-like thickened central part or from the point of its maximum external diameter. By rotating the closure cap into the first container the second container is moved into the belly region of the first container and thereby opened.

Optionally the upper part of the second container may have a region, the diameter of which is smaller than the smallest internal diameter of the bottle neck of the first container, the height of this region being preferably greater than the height of the constriction.

Within the scope of the present description of the invention the phrase "external diameter of the second container approximately the same size as the internal diameter of the constriction" means that the second container can be fitted tightly into the constriction at the site of this external diameter. The joint is preferably tightly sealed against moisture or a liquid such as water.

The first container comprises a belly region, and above it a tapering shoulder region followed by a bottle neck. The bottle neck preferably has a smaller internal diameter than the internal diameter of the belly region. The bottle neck itself forms a constriction or a constriction is formed in the bottle neck.

The constriction on the inside of the bottle neck of the first container may be formed on the opening region, e.g. in the form of an encircling inwardly directed edge, it may be formed immediately above the shoulder region or between them. Preferably it is located immediately above the shoulder region. The constriction may be in the form of an edge, a thickened region or a waist. The constriction is preferably constructed as a ring which peripherally encircles the bottle neck. However, it may also be in the form of one or more raised points, edges with recesses, etc.

The constriction has the function of securing the second container in tight fitting manner in the bottle neck. An annular peripheral constriction is preferred, preferably one which is able to form a total seal relative to the second container. It may also be constructed as a press fit relative to the second container.

In some embodiments the top edge of the constriction may have the function of limiting the downward movement of the second container. In such cases, means which can abut on the top edge are formed on the second container.

In alternative embodiments the bottle neck has no additional constriction but the bottle neck itself takes on this function (a bottle neck acting as a constriction), particularly the function of a sealing point. The function of the top edge of the constriction is then taken on by the top edge of the bottle neck. In such cases a bottle neck of limited height is advantageous. Therefore, within the scope of the present invention, in every embodiment with a constriction, basically this constriction may be replaced by a bottle neck acting as a constriction. For simplicity sake within the scope of this description reference is made predominantly to a bottle neck with a constriction. Unless it is otherwise apparent from the context, the term constriction also includes a bottle neck acting as a constriction. However, embodiments with a separate constriction formed in the bottle neck are preferred.

The second container is designed so that when the packaging unit is first sealed it is located in the neck of the first container, where it fits tightly in the constriction in the bottle neck so that on the one hand it is tightly fitting but on the other hand it can be moved axially. By axially is meant the direction corresponding to the longitudinal axis of the first container running from the opening in the bottle neck to the base region of the belly region.

The second container has a pot-like lower part which is oriented towards the belly region of the first container when the packaging unit is in its initial closed state. Adjoining this in the upward direction is an upwardly open upper region. This upper region may comprise a central part and an upper part, the central part connecting the lower part to the upper part.

The second container preferably has a bead-like thickened region above the lower part, forming the maximum external diameter of the second container. This external diameter is substantially the same size as the internal diameter of the constriction. This thickened region may also be formed on the upper part of the upper region of the second container. As a result the second container may, together with the constriction, seal off the bottle neck of the first container. Therefore, this thickening portion is preferably formed in a ring around the outer casing of the second container. This region and the constriction in the first container form the sealing point. This sealing point seals the interior of the first container from the outer environment.

The internal diameters of the lower part and upper region of the second container may differ analogously or they may be the same size.

The external diameter of the lower part and the external diameter of the upper region of the second container may be the same size, apart from the thickened portion. These external diameters of the second container may be less than the internal diameter of the constriction so that the second container can be moved more easily in the axial direction in the bottle neck of the first container.

The cylindrical upper part may optionally have two or more recesses extending axially from the top down to the central part.

The upper part is closed off by a cup-like lid. This lid sits firmly on or in the upper part. In embodiments in which the upper part has recesses the lid extends from the top into the central part of the second container so that the second container is firmly closed.

The lid is clamped into the second container.

The lid may also have flange-like projections constructed so that in the closed state of the second container they pass through the above-mentioned recesses in the upper part at their end nearest the base and are located above the constriction in the first container or abut on the upper side thereof. In other words, in these embodiments, the lid sits directly on the central part while the upper part of the second container extends over it.

The exterior of the cup-like lid abuts on the inside of the second container, preferably level with the central part, in a sealing position.

It has been found that during the closure process pressure differences inside the second container can cause turbulence in the powder. Such turbulence can be reduced if the sealing region of the lid is formed directly below the flange-like projections and is of limited height. Particularly advantageous embodiments are those wherein the outer contour of the lid has recesses extending from the base end towards the top end without touching the top end. As a result, an annular, peripherally encircling and fully sealing region in the shape of a band is formed at the top end of the outer contour of the lid, i.e. the end with the flange-like projections. Underneath this is a region whose outer diameter is the same as that of the first region but which has one or more recesses. These recesses serve briefly as an air exit for air which has been displaced out of the interior of the second container during the closure process. This lower region of the exterior of the cup-like lid, provided with recesses, may also be described as a region of smaller external diameter on which webs are formed which extend axially, i.e. parallel to the height of the lid, from the base to the lower edge of the sealing region. A ring which peripherally encircles the webs would then have the same internal diameter as the external diameter of the sealing region.

The cup-like lid has no openings whatsoever but rather seals off the second container so that there can be no exchange of substances between the interior and exterior.

The sealing region of the lid and the sealing region of the inner casing of the second container may have latching means formed to complement one another, e.g. in the form of an annular peripheral groove and spring.

Fins may be provided on the outside of the base of the second container to prevent the second container from unintentionally closing off the opening region or neck of the first container when it is emptied. These fins are in the form of surfaces with limited thickness. For example, they may be in the form of rectangles or triangles with sharp or rounded corners. The side edges and/or surfaces may be straight, or with a convex or concave curvature or corrugated.

To the side, the fins do not project over the outer region of the second container with the maximum external diameter and preferably they do not project laterally over the region with the smallest external diameter. They may be formed individually or in pairs. Preferably, there is one pair or two pairs at right angles to one another.

The closure cap is constructed so as to comprise an outer cylinder with an internal screw thread and, integrally formed thereon, an inner cylinder with a sealed base region. The inner cylinder engages in the opening region of the first container and abuts on the upper end of the cylindrical upper part of the second container.

These features enable the second container to be frictionally held in the cylindrical constriction in the first container by means of its bead-like thickened central part or by the point of its maximum external diameter. By rotating the closure cap into the first container, the second container is pushed into the belly region of the first container. During this movement the lid is left hanging from the constriction in the first container by means of its flange-like projections so that the lid is released from the clamping and closing position. This opens up the second container. In one embodiment the opened second container can now drop through into the belly of the first container. In this way the substance in the second container is released to mix with the substance in the first container.

During the downward movement of the closure cap towards the second container the inner cylinder of the closure cap pushes the second container through the constriction or the bottle neck acting as a constriction. On the inner cylinder of the closure cap there may be a cylindrical projection which frictionally engages in the cup-like region of the lid of the second container from above as the closure cap moves downwards. If the closure lid is then rotated and removed from the first container it takes this cup-shaped lid of the second container with it.

In particular embodiments, the cylindrical projection has latching means on its exterior and the cup-like lid has complementary latching means on its interior, e.g. in the form of an encircling groove and spring or the two corresponding components of press-studs and the like. The groove-like peripheral ring or the groove-like recess may be formed on the inside of the cup-like part of the lid and then complementary latching means may be formed on the exterior of the cylindrical projection, or vice-versa. These latching means make it easier for the lid of the second container to be frictionally moved by the closure cap when its cylindrical projection is inserted into the top of the lid which is bent downwards in a cup shape.

In a number of embodiments the upper part of the second container terminates in one or more flange-like projections which, like the projections of the cup-like lid point outwards. If there are a number of flange-like projections on the upper part of the second container these are separated from one another by the above-mentioned recesses. However, it is also possible to have only one single peripherally encircling projection or flange. The recesses then pass through this peripherally encircling flange. If the container is then moved downwards the sealing centre part again passes through the constriction. However, the second container does not fall through into the first container but is held by its projections or the flange on the upper side of the constriction. In these embodiments the recesses in the upper part of the second container are then used. They are sufficiently high so that they bridge the lower region of the second container which has passed through the constriction to the region of the second container which has not yet passed through the restriction. In other words the recesses are higher than the height of the constriction. This ensures that in this position the interior of the first container is able to communicate with the outer environment after the lid and the closure cap have been removed. The path of communication leads from the interior of the first container on the outside of the lower part and of the centre part of the second container through the recesses into the opening region of the first container. In order that this path of communication is kept unobstructed even when the first container is moved, e.g. tilted, it is advantageous if at least the upper region of the exterior of the upper part of the second container has an external diameter of a similar size to its central part. A second bead-like thickened portion may be formed here, for example. In fact, in this case, the second container in the opened end position is held frictionally in the opening region by this region so that it does not change its position relative to the first container when the first container is moved. The region of the upper part with the larger external diameter and the region of the central part which also has a larger external diameter than the other parts of the second container may be separated by a region of lesser external diameter. The two regions may also merge into one another with the external diameter remaining constant. This latter variant, however, requires much greater application of force to push the second container through the constriction in the first container than the first variant.

In embodiments having a flange or a number of projections at the top end of the upper part of the second container in which the container is frictionally held in its end position in the bottle neck, it is not essential for the lid to have projections by which it is retained. In this case it is sufficient if the force required so that the lid is frictionally held by the cylindrical projection of the closure cap is less than the force required to push the container frictionally into its end position. Moreover, the force required to open the lid must be less than the force required to move the container out of its end position.

In this case, first of all the lid can engage frictionally in the cylindrical projection as the closure cap moves downwards before the container is pushed into the end position. If the closure cap is opened it takes the lid with it without removing the container from its end position as the frictional connection between the lid and the second container is less than the connection between the second container and the first container. In embodiments of this kind in which the second container is intended to remain in the bottle neck, i.e. has a flange or projections at its upper end, the lid can only engage in the cylindrical projection when the end position of the second container has been reached. In these cases the lid preferably has latching lugs on the inside of its cup-shaped upper part which engage in the corresponding groove on the exterior of the cylindrical projection or vice-versa.

In another embodiment the second container has on the outside of its lower part, in addition to or instead of the bead or the peripherally encircling region of maximum external diameter which acts as a seal, at least one barb-like member. This is designed to ensure that the second container can only be pushed through the constriction in the first container from above from one direction, namely with the lower part first. Preferably this latching member is in the form of a wedge the tapering side of which extends downwardly towards the base of the container while its top is constructed as an edge which stands perpendicularly or substantially perpendicularly on the casing of the second container.

In this case the lid itself may engage frictionally with its upper side in the cylindrical projection of the closure cap, or the closure cap itself may form the cylindrical lid. The latter is preferred.

The central part and upper part of the second container may be a single element, e.g. with a smooth outer skin. The external diameter of the central part and/or upper part of the second container is less than the internal diameter of the constriction, so that this part of the second container can pass through the constriction without any friction. Preferably the height of the second container from the top edge of the barb-like member to the top edge of the neck of the second container is less than the height from the lower edge of the constriction to the top edge of the neck of the first container. Most preferably, the height from the top edge of the barb-like member to the top edge of the neck of the second container plus the height of the region into which the lid of the second container or the sealing region of the cylindrical projection of the closure cap projects, is less than the height from the lower edge of the constriction to the upper edge of the neck of the first container.

In this embodiment the packaging unit is produced by first filling the second container with the substance which is to be stored and then closing it off with the lid or by means of the cylindrical projection of the closure cap. Then the second container is pushed through the constriction with its lower end first, as described in the other embodiments. The force required to push the barb-like member through relative to the constriction has to be overcome. The closure cap is then firmly screwed on.

If the closure cap is then opened the second container is carried upwards by its movement, by means of the frictional connection of its lid or directly by the closure cap, until the barb-like member of the lower part is left hanging from the constriction. As the closure cap is opened further its attachment to the second container is broken (carried along by the lid, in embodiments in which the lid is separate) and then second container falls into the first container.

The packaging unit according to the invention advantageously differs from the known packaging units in that, inter alia, a separately produced lid can be provided for the second container, placed thereon, so that the second container can be filled separately at a different location and time and stored and transported separately from the first container. To prepare the mixture the lid is detached from the second container without destroying it so that no fragments of the lid or container material are produced which might get into the mixture. After the second container has been moved out of its original position the mixture can easily be removed in portions and the packaging unit can be reliably sealed. The proposed packaging unit is easy to manufacture and easy to handle and use by the end user. Preferably, the invention is used for preparing pharmaceutical formulations such as antibiotics or vitamin formulations and/or formulations for food supplementation, for example. In such cases a powder may be stored in the second container and a liquid in the first.

The packaging form according to the invention has the additional advantage that the interior of the second container can be stored dry and it is impossible for liquid to diffuse out of the interior of the first container through seams into the interior of the second container. Moreover, the second container tightly seals off the interior of the first container against water vapour which might penetrate along the screw thread of the closure cap into the interior of said cap and vice-versa. Further advantages and embodiments of the inventive concept are described in the subsidiary claims. Some details are explained more fully with reference to the embodiments illustrated in the drawings. In these drawings:

Figure 1:
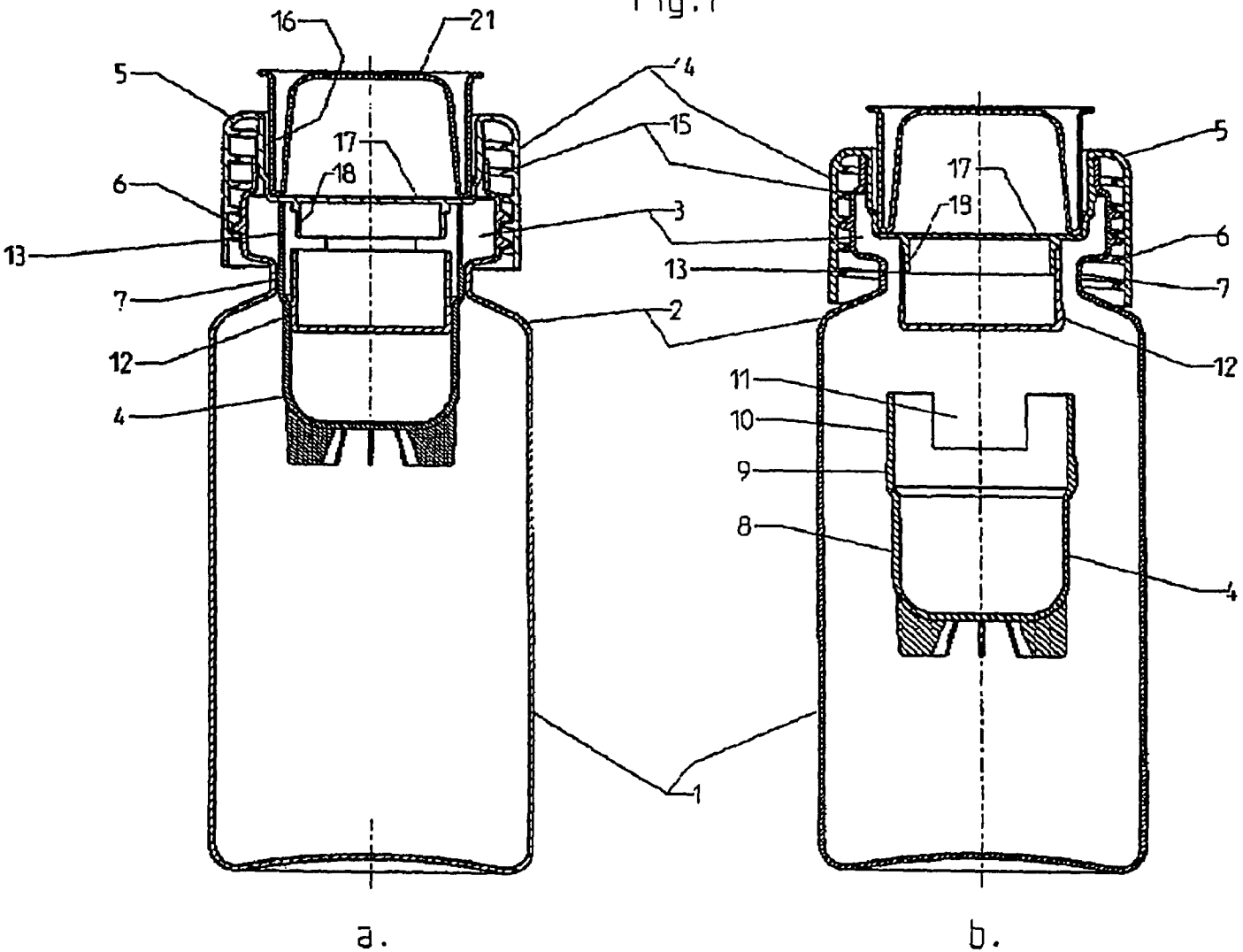
FIG. 1 Shows a first embodiment of the packaging unit according to the invention in longitudinal section FIG. 2 Shows a second embodiment of the packaging unit according to the invention in longitudinal section.
Figure 2:
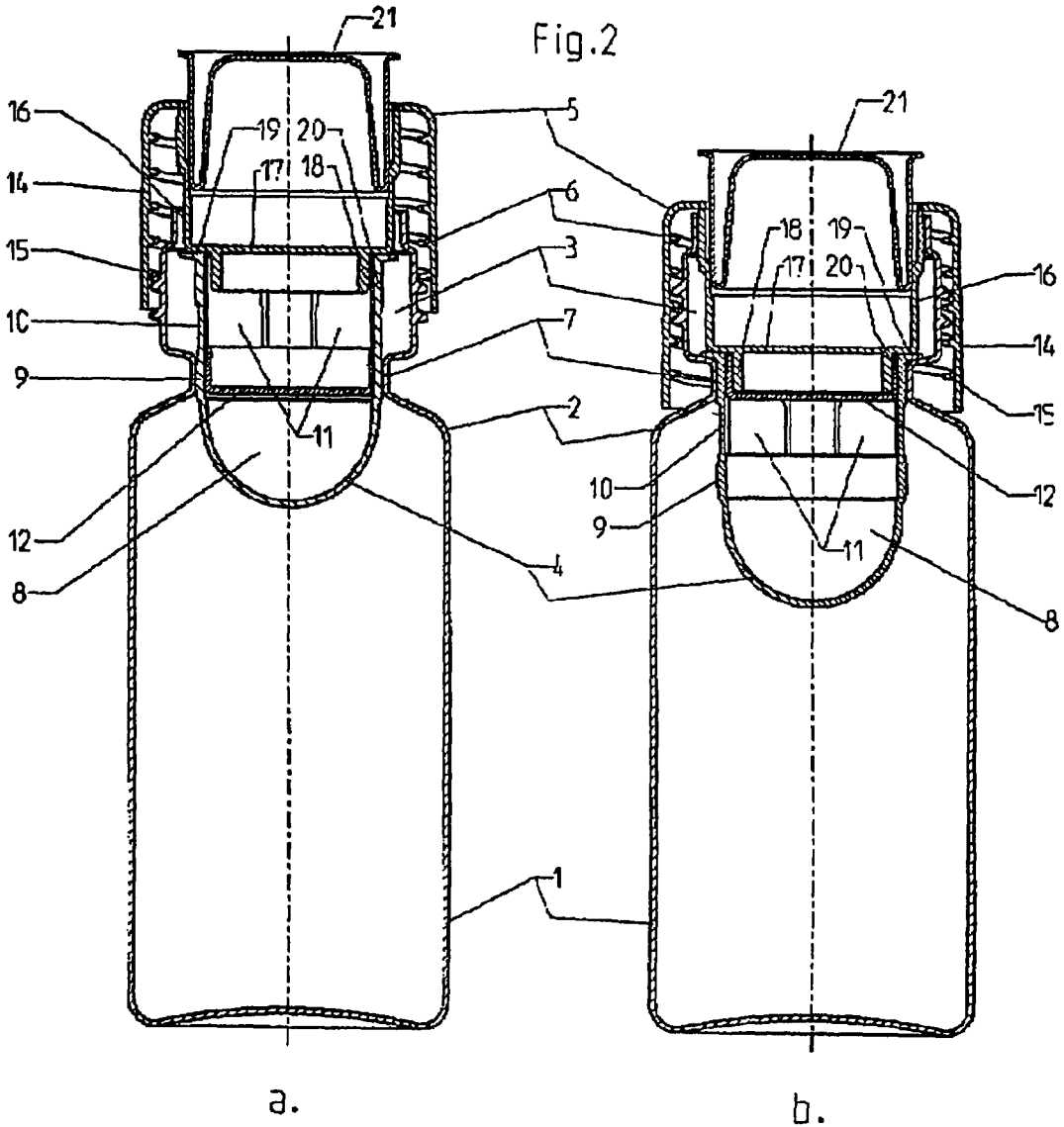

In FIGS. 1 and 2, references a and b denote the positions of the second container relative to the first container before and after the start of the mixing process.

The packaging unit shown in FIG. 1 comprises a total of 5 components to be produced separately. The first bottle-like container 1 has a shoulder region 2 and an opening region 3 indented in the form of a neck, which is provided with a screw thread 6 at its end. Between the screw thread 6 and the shoulder region 2 is a cylindrical constriction 7 which serves to frictionally secure the second container 4. The second container consists of a pot-shaped lower part 8, a bead-like thickened central part 9 and a cylindrical upper part 10 which is provided with two or more axially extending recesses 11. In order to close the second container 4 a cup-like lid 12 is inserted therein, the axial dimension of which is greater than that of the bead-like thickened central part 9 of the second container and which engages in frictionally locking manner in the pot-shaped lower part 8 of the second container 4. The cup-shaped lid 12 is provided with flange-like projections 13 by means of which it abuts on the upper side of the constriction 7, passing through the recesses 11 in the upper part 10. Two pairs of fins in the form of surfaces shaded in grey are shown at the base of the lower part. One pair is positioned perpendicularly to the observer.

The closure cap 5 comprises an outer cylinder 14 with an internal screw thread 15 and an internal cylinder 16 integrally formed thereon having a sealed base region 17. The inner cylinder 16 engages in the opening region 3 of the first container and abuts on the upper end of the cylindrical upper part 10 of the second container 4. The closed base region 17 of the closure cap 5 has a cylindrical projection 18 which is of suitable dimensions for engagement in the cup-like lid 12.

The fifth part of the packaging unit shown is a measuring cup 21 for the end user to measure out the mixture; this cup 21 can be jammed into the inner cylinder 16 of the closure cap for storage. Instead of the measuring cup other metering aids may be provided in the packaging unit.

In order to prepare the mixture the closure cap 5 is moved out of the position shown in FIG. 1*a* after the removal of a conventional safety ring (not shown) by rotating in the direction of the shoulder region 2 of the first container 1, as a result of which the second container 4 is pushed towards the interior of the container 1 and finally released from its secured position in the constriction 7. It can then drop into the container 1 and serve as a mixing aid when the container is shaken.

By the translatory movement of the closure cap 5 out of the position in FIG. 1*a* into the position in FIG. 1*b* the cylindrical projection 18 on the base region 17 is also pressed into the cup-like lid 12, so that the lid 12 together with the closure cap 5 can be removed from the container 1 when the mixture is to be poured out. As the cup-like lid abuts with its flange-like projections on the upper side of the constriction and as the second container 4 has axially extending recesses 11, the container 4 can be moved by translation as a result of the actuation of the closure cap 5 and released from its frictional mounting in the constriction 7 without the cup-shaped lid 12 also having to perform this movement. Rather, it is fixed in its original position in translatory manner relative to the container 1, as a result of which final separation between the container 4 and lid 12 is achieved.

In the embodiment according to FIG. 2 the bottle-like container 1, the closure cap 5 and the measuring cup 21 do not differ from the embodiments shown in FIG. 1. They will therefore not be described here to avoid repetition. The second container 4 and the cup-like lid 12 were modified. The cylindrical upper part 10 of the second container 4 is in turn provided with axially extending recesses and the cup-like lid also has flange-like projections 13 (not shown) with which it engages through the recesses 11 as it abuts on the top of the constriction. In contrast to the embodiment shown in FIG. 1 the upper part 10 of the second container 4 is provided at one end with an encircling flange 19 and directly underneath the flange 19 with a second bead-like thickening 20. The axial dimension of the cup-like lid 12 is smaller than in the embodiment shown in FIG. 1 and also the lid does not engage in the lower part 8 but instead engages in the central part 9 of the container 4.

During translatory movement of the closure cap 5 towards the shoulder region 2 of the container 1 the container 4 is pushed out of its position shown in FIG. 2*a* towards the interior of the container 1 and released from its frictionally secured mounting in the constriction 7 and finally brought into the position shown in FIG. 2*b* in which the encircling flange 19 abuts on the top of the constriction 7 and the container 4 is frictionally secured by means of its second bead-like thickening 20 in the constriction 7. At the same time the cylindrical projection 18 of the closure cap 5 again engages in the cup-like lid 12 as a result of which this is held in clamped manner by the closure cap 5 and is removed from the opening region 3 when the closure cap 5 is unscrewed. The axially extending recesses 11 in the upper part 10 of the container 4 are longer than the height of the constriction 7. This ensures that the recesses 11 in the position shown in FIG. 2*b* connect the interior of the first container to the opening thereof, i.e. they open up the constriction 7 which was previously closed off by the bead-like central part of the second container and allow communication between the interior of the container and the outer environment as soon as the closure cap together with the lid 12 secured on the projection 18 is unscrewed. Consequently, in this embodiment, the recesses 11 act not only as an accommodation opening for the flange-like projections 13 of the lid 12 but—as the container 4 remains in the position shown in FIG. 2*b* in the container 1—act as outlet openings for the liquid inside the container. In the position shown in FIG. 2*b*, i.e. after the closure cap has been rotated relative to the first container, so that the second container has been opened and before the closure cap is removed, a powder in the second container can be mixed with the liquid in the first container through the recesses 11 by shaking the first container.

There are recesses (not shown) in the encircling flange 19 for the flange-like projections of the lid 13, which are not visible in FIG. 2, so that both the flange-like projections of the lid and also the encircling flange 19 of the container 4 can abut in one plane on the top of the constriction 7 in the container 1. In the second embodiment the container 4 is not freely movable in the container 1, thereby eliminating unwanted noise during the mixing process.

Figure 3:
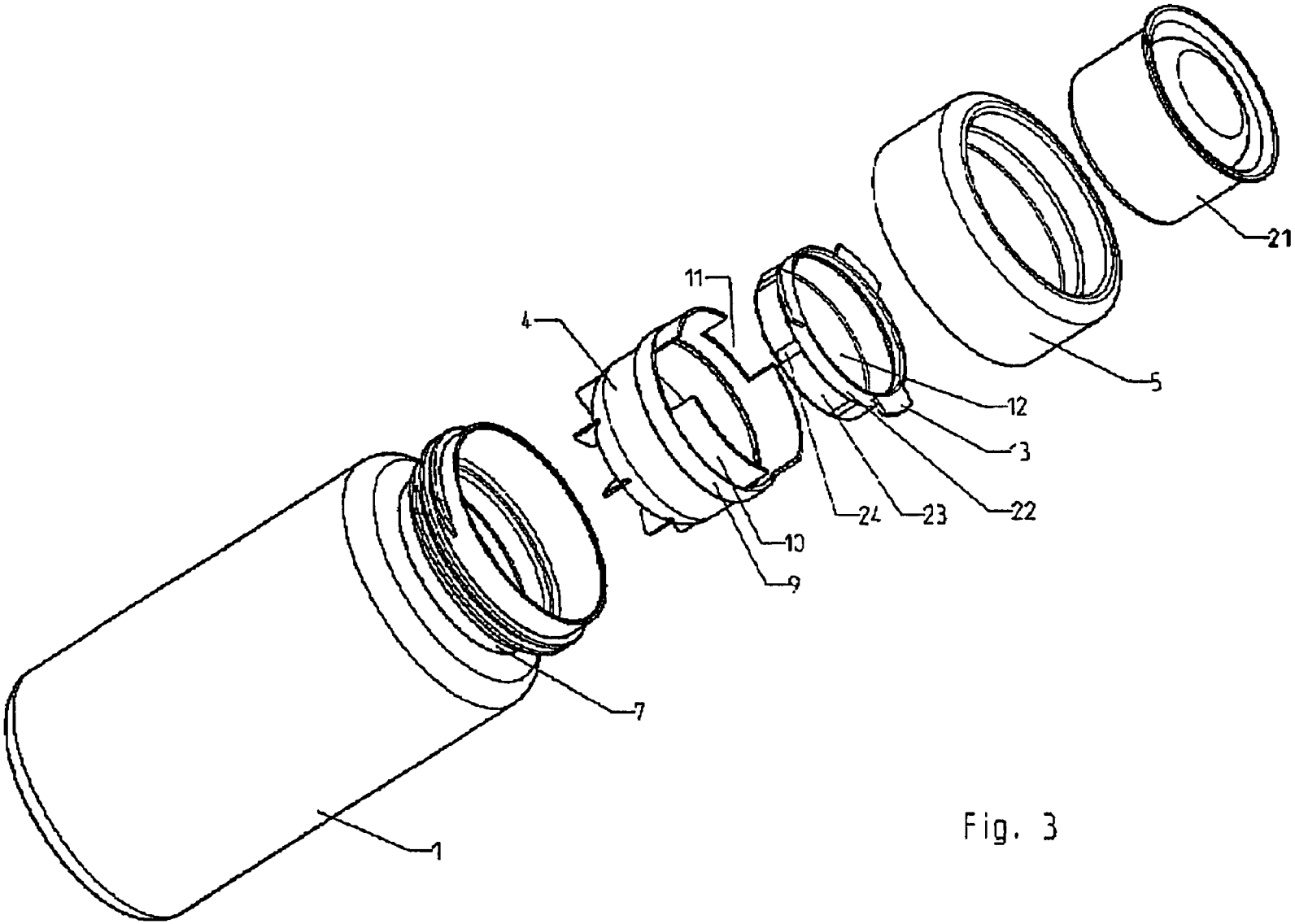
FIG. 3 Shows an exploded view of the embodiment according to FIG. 1.

FIG. 3 shows an embodiment according to FIG. 1 with the first container 1 and above it the second container 4 with a thickened central part 9, upper part 10 and recesses 11, and above that the cup-shaped lid 12 with flange-like projections 13, a sealing peripherally extending region 22, webs 23 and recesses 24. Above that is the closure cap 5 into which the measuring cap 21 can be fitted.

Figure 4:
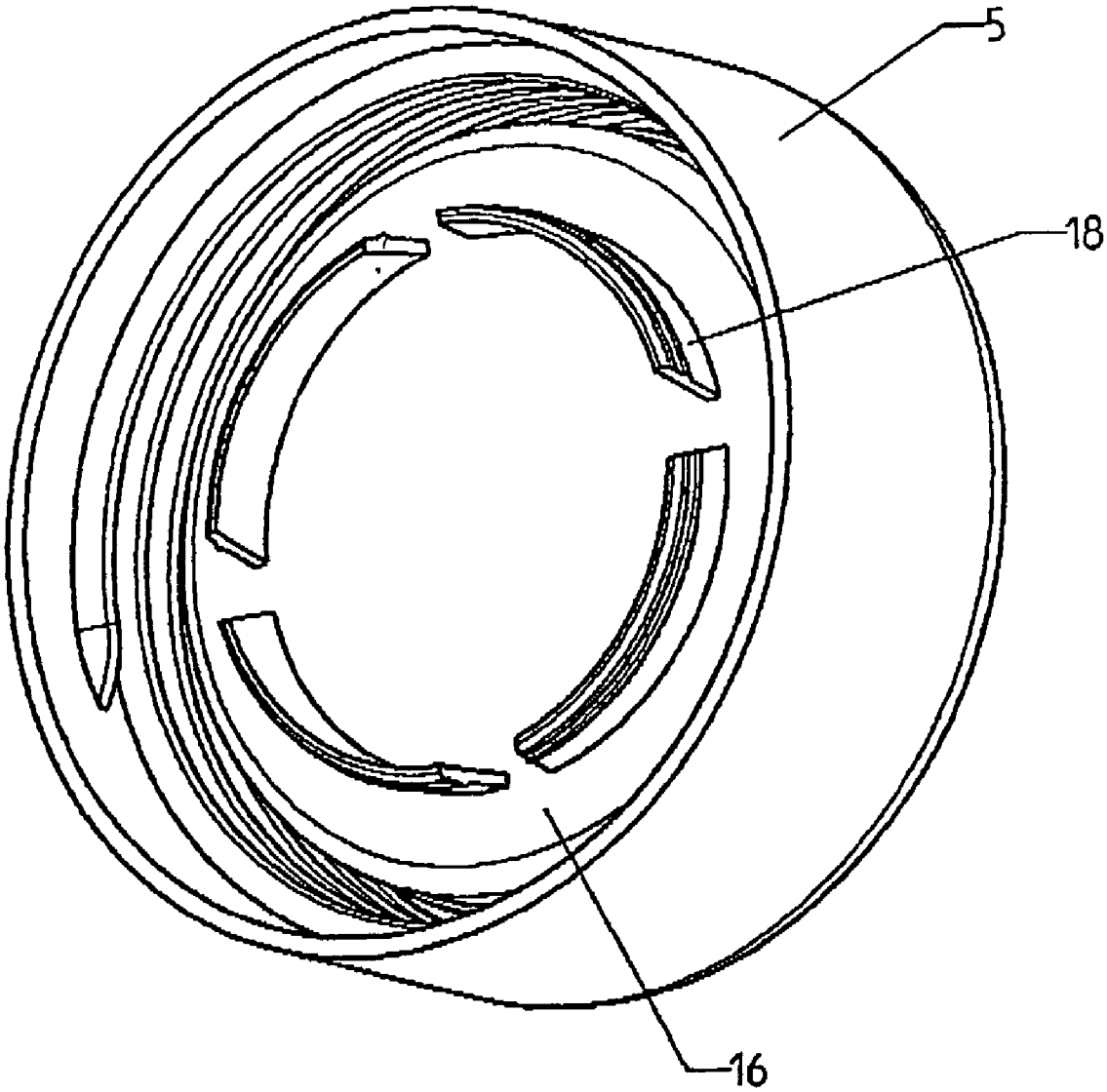
FIG. 4 Shows a view of the closure cap from below.

FIG. 4 shows the closure cap 5 from below. The drawing shows the cylindrical projection 18 which can engage frictionally in the cup-shaped lid 12. In this case the cylindrical projection has recesses. The inner cylinder 16 at the base of the cylindrical projection 18 is the part of the closure cap 5 which can make contact with the container 9 at its upper part and pushes it through the constriction 7.

Figure 5:
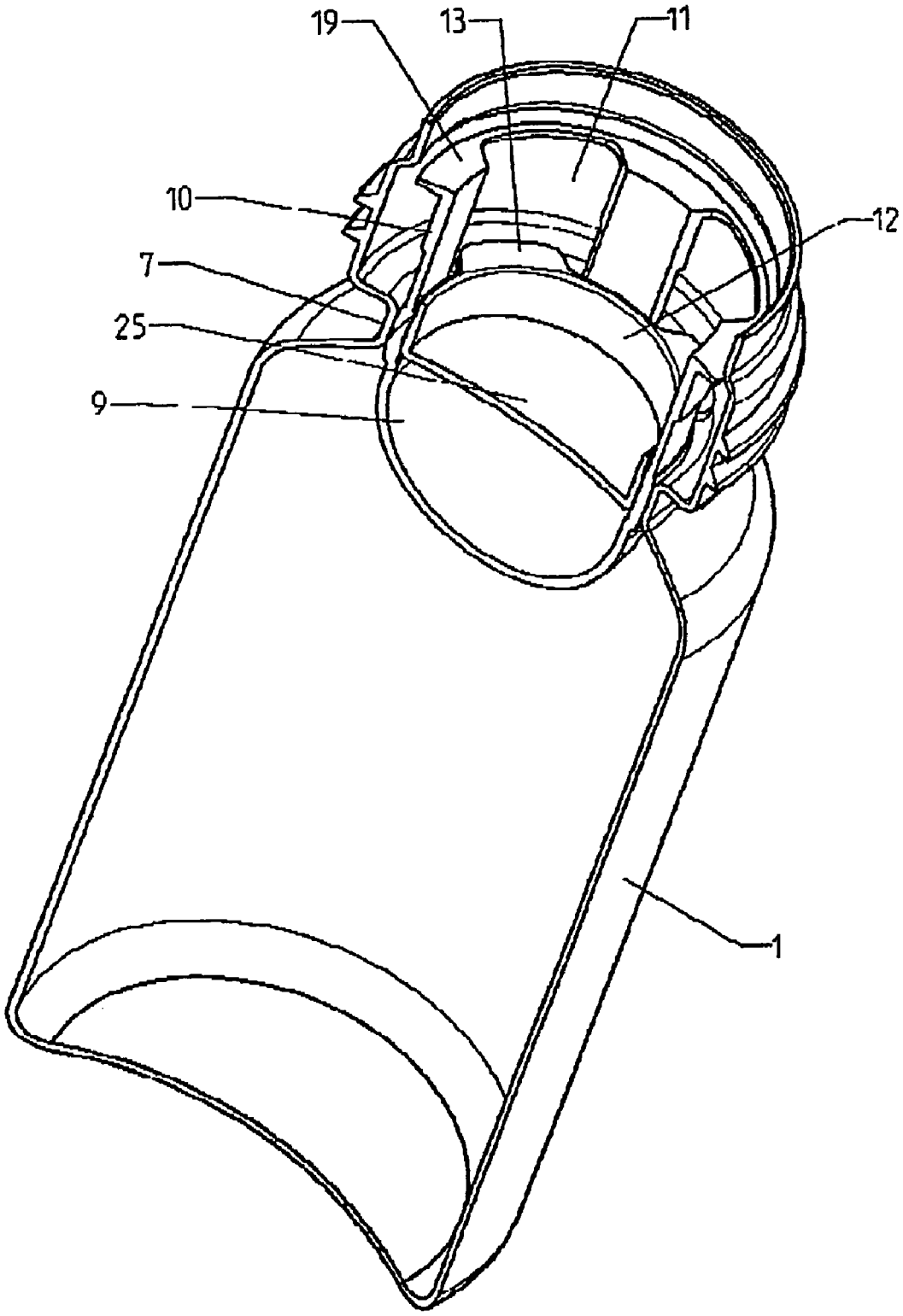
FIG. 5 Shows a view of an embodiment according to FIG. 2 with a peripherally encircling flange on the upper part of the second container in cross section.

FIG. 5 shows an embodiment according to FIG. 2 with recesses 11 in the upper part 10 of the second container 9. The upper part of the container terminates in a peripherally encircling flange 19 which is penetrated by the recesses 11. The cup-shaped inner region of the lid 25 is clearly visible.

The exploded view shown in FIG. 3 also defines the terms "top" and "bottom" used in connection with this specification. The direction "upwards" is the direction defined along the longitudinal axis of the container from the container base to the measuring cylinder. The direction "downwards" is the opposite direction.

The terms "top" and "bottom" for each of the individual elements accordingly derive from these directions. The terms "inside" and "outside" are defined analogously: the inside is in each case the side facing the central axis of the container. The outside is accordingly the side of an element facing away from the central axis. The terms "inside" and "outside" are defined accordingly.

The term "height" is defined as a measurement of length parallel to the central axis of the container facing from the top to the bottom.

What is claimed is:

1. A packaging unit in the form of a container with a closure cap for two substances to be stored separately from each other and mixed together before use, the packaging unit comprising a first bottle-like container (1) comprising a shoulder region (2) and an opening region (3), the opening region (3) comprising an external screw thread (6) and an annular constriction (7) with an internal diameter, a second container (4) frictionally secured in the annular constriction (7), and a closure cap (5) covering the opening region (3), wherein the second container (4) comprises a lower part (8) with a maximum external diameter that is less than the internal diameter of the annular constriction (7), an upper part (10) with a maximum external diameter that is less than the internal diameter of the annular constriction (7), and a central part (9) with an external diameter that is the same size or greater than the internal diameter of the annular constriction (7), the central part (9) being located inside or below the annular constriction (7) when the packaging unit is in an initially sealed state, the upper part (10) of the second container (4) is closed by a lid (12) that is insertable in the upper part (10).

2. The packaging unit according to claim 1, wherein the lid (12) is not an integral part of the closure cap (5).

3. The packaging unit according to claim 1, wherein the upper part (10) comprises at least two recesses (11), the lid (12) comprises flange-like projections (13) adapted to pass through the recesses (11) in the upper part (10) and abut the constriction (7), the closure cap (5) comprises an outer cylinder (14) with an internal screw thread (15) and, integrally formed thereon, an inner cylinder (16) with a sealed base region (17), the inner cylinder (16) adapted to engage the opening region (3) of the first container (1) and abut upper part (10) of the second container (4), and the second container (4) is held in frictionally locking manner with its central part (9) in the annular constriction (7) of the first container (1) in such a way that, by rotating the closure cap (5) into the first container (1), the second container (4) is pushed by the pressure of the inner cylinder (16) onto the cylindrical upper part (10) of the second container into the first container until the lid (12) is released, whereby the opening of the second container (4) communicates with the interior of the first container.

4. The packaging unit according to claim 1, wherein on the sealed base region (17) of the inner cylinder (16) of the closure cap (5) is formed a cylindrical projection (18) which is of a suitable size for engagement in the lid (12), whereby after being released from the second container (4) the lid (12) is held clamped by the closure cap (5).

5. The packaging unit according to claim 1, wherein the second container (4) comprises a pot-shaped lower part (8), a central part (9) with a greater external diameter than the lower part and a cylindrical upper part (10) with one or more axially extending recesses (11) and with an annular, peripherally encircling flange (17), while at least the region underneath the flange (17) has an external diameter which is at least equal to that of the central part and the second container (4) is tightly sealed off with a cup-like lid (12) by tight clamping, the closure cap (5) comprises an outer cylinder (14) with an internal screw thread (15) and a cylindrical projection (18) formed thereon, the cylindrical projection (18) engages in the opening region (3) of the first container (1) and rests above the cup-shaped top region of the lid (12), and the second container (4) is frictionally secured with its central part (9) in the cylindrical constriction (7) of the first container (1) so that by rotating the closure cap (5) into the first container (1) the cylindrical projection (18) pushes the second container (4) by pressure on the lid (12) until the flange (17) or minimum of one projection (18) rests on the top edge of the constriction (7) and the upper outer region of the upper part of the second container is frictionally connected to the constriction (7), while at the same time the cylindrical projection (18) also engages frictionally in the cup-shaped upper part of the lid (12) in such a way that after removal of the closure cap the lid (12) is moved along by the cylindrical projection (18) and the now exposed opening of the second container (4) can communicate with the interior of the first container.

6. The packaging unit according to claim 5, wherein the axial length of the recesses (11) in the upper part (10) is greater than the axial height of the cylindrical constriction (7).

7. The packaging unit according to claim 1, wherein the second container (4) comprises a pot-shaped lower part (8) with a barb-like member which is situated underneath the constriction (7) in the initially sealed state of the packaging unit and which has an external diameter which is at least slightly greater than the internal diameter of the constriction (7), and a cylindrical upper part (10) the external diameter of which is less than the internal diameter of the constriction (7), the second container is sealed by a releasable lid which is frictionally connected to the inside of the closure cap or is an integral part thereof, so that in the initially sealed state of the packaging unit the lower part (8) of the second container is located underneath the constriction (7) and the upper part is connected to the closure cap (5) through the constriction (7).

8. The packaging unit according to claim 7, wherein in the inner cylinder (16) of the closure cap (5) is provided a metering aid, preferably a measuring cup (21), which is frictionally secured therein.

9. The packaging unit according to claim 7, wherein the lid (12) or optionally the region of the closure cap (5) acting as a lid comprises, on its outside which provides the sealing effect with the second container, an annular, peripherally encircling sealing region (22) and axially below it a region which has at least one axially directed recess (24) which extends from the base of the lid (12) to the peripherally encircling sealing region (22).

10. The packaging unit according to claim 9, wherein axially underneath the annular, peripherally encircling sealing region (22) are formed axial webs (23) which define a peripherally encircling region have the same external diameter as the external diameter of the sealing region, this region comprising, between the webs (23), axially directed recesses (24) which extend from the base of the lid (12) to the peripherally encircling sealing region (22).

11. The packaging unit according to claim 10, wherein the axially directed recesses (24) are wider than the webs (23) between them.

12. The packaging unit according to claim 11, wherein the peripherally encircling sealing region (22) is formed underneath the top edge of the outside of the lid (12) or of the region of the closure cap (5) which serves as a lid, forming a seal with the second container.

13. The packaging unit according to claim 12, wherein the lid (12) is an integral part of the closure cap (5).

14. The packaging unit according to claim 13, wherein the external diameter of the second container above the barb-like member is approximately the same as the internal diameter of the constriction (7), so that at this point the second container is securely held in the constriction (7) in the original sealed state of the packaging unit.

* * * * *